US006344124B1

(12) United States Patent
Bhatnagar

(10) Patent No.: US 6,344,124 B1
(45) Date of Patent: Feb. 5, 2002

(54) METHOD AND APPARATUS FOR ELECTROPLATING ALLOY FILMS

(75) Inventor: Parijat Bhatnagar, Salt Lake City, UT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/671,976

(22) Filed: Sep. 27, 2000

(51) Int. Cl.[7] ..... C25D 3/56

(52) U.S. Cl. ..... 205/96; 205/97; 205/176; 205/182; 205/238; 204/230.2; 204/230.03; 204/225

(58) Field of Search ..... 205/96, 97, 238, 205/239, 176, 181, 182; 204/230.2, 230.3, 225

(56) References Cited

U.S. PATENT DOCUMENTS 5,853,557 A * 12/1998 Souza et al. ..... 205/176

OTHER PUBLICATIONS

Faust, C.L., "Principles of Alloy Plating" in: Lowenheim, F.A. *Modern Electroplating* (New York, John Wiley & Sons, 1974), pp. 486–505, No month available.

Ross, C.A. *Electrodeposited Multilayer Thin Films*, Annu. Rev. Mater. Sci. vol. 24, 1994, pp. 159–169, No month available.

* cited by examiner

*Primary Examiner*—Arun S. Phasge
(74) *Attorney, Agent, or Firm*—Casey P. August; Stephen Bongini; Fleit, Kain, Gibbons, Gutman & Bongini P.L.

(57) ABSTRACT

A compositionally modulated material electroplated film is deposited by using at least two source metal anodes in an electroplating apparatus, and changing at least one contact area between an anode an electrolyte. In order to obtain sharp boundaries between successive layers of the film, voltage can be switched from an electroplating substrate to a dummy electrode immediately before the contact area is changed, in order to allow the electrolyte to equilibrate at a new set of solute concentrations, before electroplating on the substrate is recommenced.

24 Claims, 7 Drawing Sheets

METHOD AND APPARATUS FOR ELECTROPLATING ALLOY FILMS

CROSS-REFERENCE TO RELATED APPLICATIONS

The present application is related to the inventor's applications "METHOD AND APPARATUS FOR ELECTROPLATING ALLOY FILMS", Ser. No. 09/671,223, and "METHOD AND APPARATUS FOR ELECTROPLATING ALLOY FILMS", Ser. No. 09/671,230, which were filed on the same day as the present invention pending. These related applications are herein incorporated by reference.

FIELD OF THE INVENTION

This invention pertains to a method and apparatus for depositing metal alloy films. More particularly the invention pertains to a method and apparatus for electroplating alloy metal films.

BACKGROUND OF THE INVENTION

In the semiconductor art alloys such as Aluminum-Copper are used to produce interconnect metallizations.

For various composition material films it is important to strictly control the proportions of constituent materials in the compound. In the case of solder alloys, for example, the proportions of constituent metals effect critical properties including melting point temperature, and adhesion.

One conventional method for composition film deposition is sputtering. In sputtering, a source material target having a predetermined composition is arranged in a vacuum chamber opposite a substrate onto which a film having a composition corresponding to the predetermined composition is to be deposited. The chamber is charged with a small amount of reactive or inert gas. A high voltage DC and/or high frequency discharge is struck in the gas to cause ions formed from the gas to collide with the target and knock off particles which are deposited on the substrate. Unfortunately, sputtering requires vacuum processing, complex power supplies, and is generally only suited to single substrate processing. While sputtering machines can be scaled up to handle multiple substrates, although there is little gained in economies of scale by doing so.

Another method for depositing alloy films is electroplating. In one conventional method, electroplating is carried out using inert electrodes, and an electrolyte solution bearing a plurality of solutes compounds including metals to be deposited. However, in electroplating with inert electrodes, solutes need to be constantly replenished in order to sustain continued plating. Moreover, in the case of alloy plating, solutes corresponding to different constituents of the alloy may become depleted from the electrolyte solution at different rates and this leads to uncontrolled variations in the alloy composition obtained.

In another conventional method, electroplating is carried out using an anode made of an alloy, corresponding to the alloy film which is desired. However, in practice, it has been found that the proportions of constituents in the alloy film do not, in fact, correspond to the constituents of the alloy anode. Moreover, during the course of plating, the electrolyte tends to shift towards one of the metals of the alloy in an uncontrolled manner.

An additional disadvantage of using an alloy anode is that alloy anodes tend to require more power to sustain a given rate of dissolution, compared to pure metal electrodes made of any of the alloy constituent metals.

It is also possible to produce an alloy electroplated film by using electrolyte comprising compounds (e.g., salts) of different metals which are included in the alloy, and a pure metal anode. However, as the electrolyte is used during plating, its composition shifts toward the metal of the pure metal anode.

In addition to the desirability of depositing homogeneous alloy films, it is desirable, for certain applications such as high corrosion resistance films, and thin film microelectronic devices, to produce Compositionally Modulated Multilayers (CMM), which are also know as Functionally Graded Materials (FGM). CMM or FGM films, are characterized by constituent element proportions which vary in a predetermined manner as a function of depth in the film.

One conventional method for obtaining multilayer metal films is to repeatedly transfer a substrate between a plurality of plating baths each of which deposits a film of a particular composition on the substrate or an underlying film. However, using multiple plating baths is complicated, and such a process is also hampered by the problem of contamination and oxidation during transfer of the substrate which can passivate a surface layer on the substrate and create difficulty for further plating. The oxidation might create another layer between the two desired layers rendering the substrate unsuitable for its application It would be desirable to have a method and apparatus for depositing CMM films that avoids interfacial contamination and oxidation between layers of the CMM.

It would also be desirable to have a system and method which overcomes the above mentioned shortcomings.

SUMMARY OF THE INVENTION

Briefly, one embodiment of the present invention provides, an apparatus for depositing a composition film comprising a first metal and a second metal on a substrate. The apparatus includes a container for containing an electrolyte including a first dissolved disassociated compound including the first metal, and a second dissolved disassociated compound including the second metal. Additionally there is a support for an first anode which includes the first metal, a support for a second anode which includes the second metal, and a servo for changing a contact area between the first anode and the electrolyte.

BRIEF DESCRIPTION OF THE FIGURES

The subject matter which is regarded as the invention is particularly pointed out and distinctly claimed in the claims at the conclusion of the specification. The foregoing and other objects, features, and advantages of the invention will be apparent from the following detailed description taken in conjunction with the accompanying drawings.

DETAILED DESCRIPTION OF THE PREFERRED EMBODIMENTS

It should be understood that the embodiments presented below are only examples of the many advantageous uses of the innovative teachings herein. In general, statements made in the specification of the present application do not necessarily limit any of the various claimed inventions. Moreover, some statements may apply to some inventive features but not to others. In general, unless otherwise indicated, singular elements may be in the plural and vice versa with no loss of generality.

Figure 1:
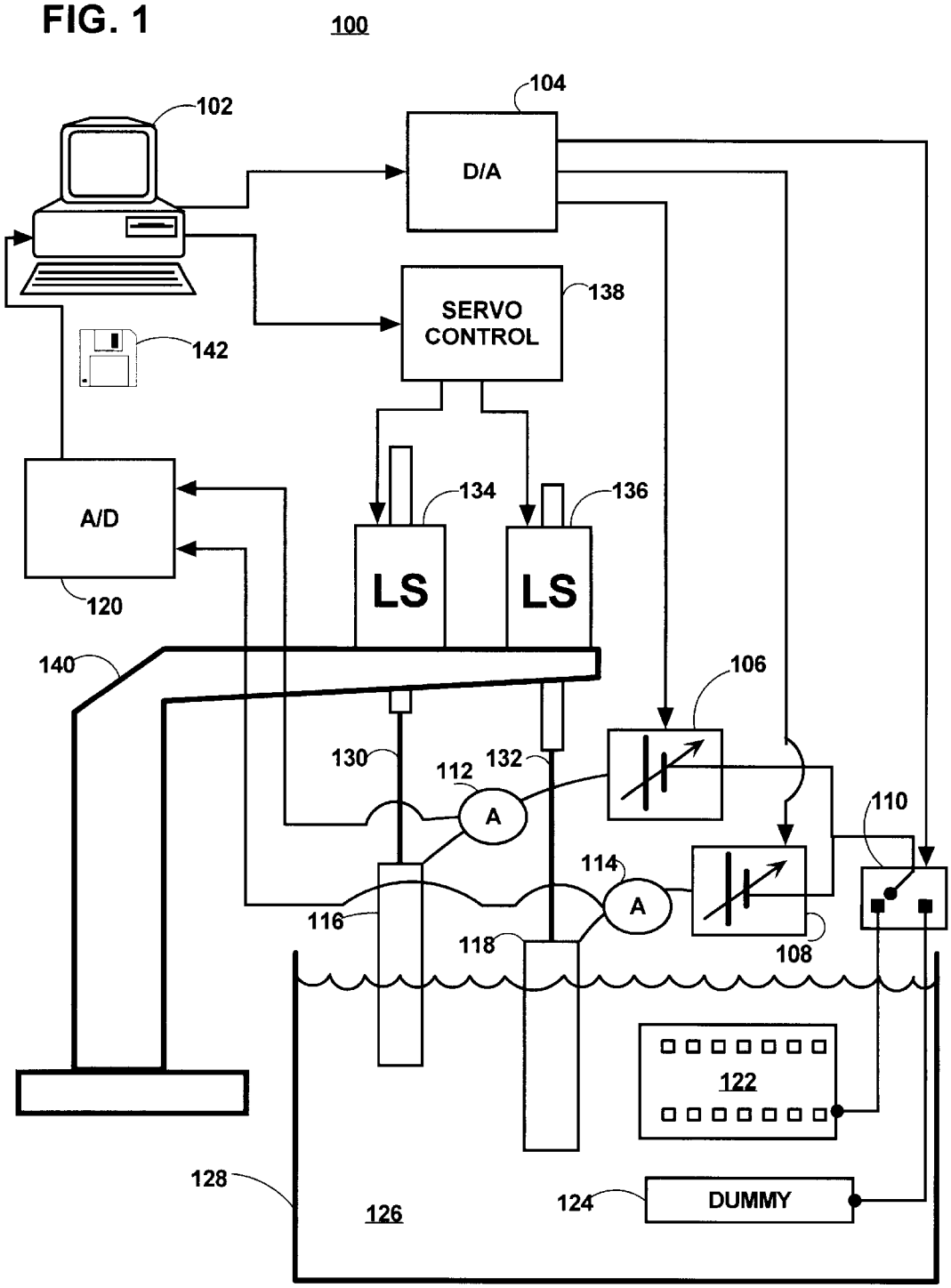
FIG. 1 is a schematic of an electroplating apparatus according to a first embodiment of the present invention.

FIG. 1 is a schematic of an electroplating apparatus 100 according to a first embodiment of the invention.

As shown, the electroplating apparatus 100 includes a control computer 102, which can for example be an IBM personal computer. The control computer 102 is electrically coupled to a digital-to-analog converter 104 (e.g., through an ISA card slot of the computer 102). The digital-to-analog converter is electrically coupled to the control inputs of a first variable power supply 106, and a second variable power supply 108. The power supplies 106 and 108 are for example switch mode power supplies, in which a voltage received at a control input is used to determine a power switch duty cycle.

An anode terminal of the first power supply 106 is electrically coupled through a first ammeter 112, to a first electroplating source metal anode 116 (e.g., nickel). An anode terminal of the second power supply 108 is electrically coupled through a second ammeter 114 to a second electroplating source metal anode 118 (e.g., Iron). The first and second ammeters 112 and 114 have signal outputs coupled to an analog-to-digital converter 120. The analog-to-digital converter 120 is in turn electrically coupled to the control computer 102 (e.g., through an ISA card slot). The control computer receives readings from the ammeters 112, and 114 through the analog-to-digital converter 120. Although two anodes 116, 118 are shown, more than two anodes can be provided in order to produce electroplate alloy coatings with more than two metals.

Two negative terminals of the variable power supplies 106 and 108 are coupled to an input pole of a single pole double throw relay 110. A control input of the relay 110 is electrically coupled to the digital-to-analog converter 104, so that the control computer 102 can operate the relay 110 through the digital-to-analog converter 104. An amplifier (not shown) such as a Darlington pair can be interposed between the digital-to-analog converter and the control input of the relay 110. A first output of the relay 110 is electrically coupled to an electroplating substrate (working electrode) 122. A second output of the relay 110 is coupled to dummy electrode 124.

In general the single pole double throw relay 110 can be any type of electrical device (e.g., switch, switch network) for selectively coupling between an input terminal and either of two output terminals, (i.e., coupling between the negative terminals of the power supplies 106, 108 and either the substrate 122 or the dummy electrode 124).

During operation, the first and second power supplies 106, 108 apply first and second voltages between the anodes, 116 and 118 and either the substrate 122, or the dummy electrode 124.

The first and second anodes 116 and 118 are supported in an electrolyte solution 126, which is held in a container 128. The electrolyte solution 126 includes a first dissolved and disassociated compound (e.g., a salt) that includes a metal included in the first anode 116, and a second dissolved and disassociated compound including a metal included in the second anode 118. The electrolyte solution 126 can also include other solutes such as organic solutes known in the electroplating art as for decreasing the porosity of deposited films and for achieving fine surface finish.

The first anode 116 is supported by a preferably electrically insulating tether 130, which mechanically connects it to a first linear motion servo 134. Likewise, the second anode 118 is supported by a tether 132 by which it is connected to a second linear motion servo 136. The linear motion servos 134 and 136 are supported by a support 140. The linear motion servos 134 and 136 control depths of insertion of the first and second anodes 116 and 118, and thus operate to change the contact areas between the first and second anodes 116 and 118 and the electrolyte solution 126. The first and second linear motion servos 134 and 136 are electrically coupled to a servo controller 138 and the servo controller 138 is electrically coupled to the control computer 102. The control computer, under program control, drives the servo controller 138 to change the areas of the first and second anodes 116, 118 which are in contact with the electrolyte solution.

As an alternative to the linear motion servos 134, 136, other arrangements can be provided for varying the contact areas between the anodes 116 and 118 and the electrolyte solution 126. For example, stepper motors that are mechanically coupled to the anodes 116, 118 can rotate the anodes into the electrolyte solution 126 to varying degrees. As a further alternative, an area of contact between a stream of electrolyte solution in a circulation circuit and an anode in the circulation circuit can be altered, (e.g., by deflecting the stream or moving the anode). A computer readable medium 142 can be used to load software onto the control computer 102, for configuring it to control the electroplating apparatus 100 in order to deposit the CMM films in the manner described above and below.

In operation, a setting of one of the variable power supplies 106 and 108 or settings of the two variable power supplies, or a contact area between the electrolyte 126 and one of the anodes 116 and 118, or two contact areas between the two anodes 116 and 118 and the electrolyte 126, is varied during the plating process in order to change the composition of the film being plated onto the substrate 122 in order to deposit a CMM film. If the relay 114 is maintained so as to supply power to the substrate 122 while the voltages and or areas are changed, then a composition of the deposited CMM will vary gradually through the thickness of the film because the electrolyte composition changes gradually.

In order to obtain a sharp transition in the composition between a first layer of a CMM and an adjacent second layer of the CMM film, the electroplating apparatus can be operated for a first period with the relay 110 set to supply power to the substrate 122 with a first set of power settings of the power supplies 106 and 108 and with a first set of contact areas of the anodes 116 and 118. The first set of settings comprises a setting (e.g.,voltage or current) of the first power supply 106 and a setting (e.g., voltage or current)

of the second power supply 108. During the first period, a first set of concentrations of the first and second dissolved disassociated compounds will be obtained in the electrolyte 126, and an electroplate film layer of a first predetermined composition will be deposited. At the end of the first period, the relay 114 is switched to supply power to the dummy electrode 124.

During a second period in which power is supplied to the dummy electrode, at least one voltage of the power supplies 106, 118, and/or at least one contact area between at least one of the anodes 116 and 118 and the electrolyte 126 is changed. During the second period, a second set of concentrations of the first and second dissolved disassociated compounds will be obtained in the electrolyte. The second period is preferably sufficient in duration to allow the electrolyte to equilibrate at the second set of concentrations. At the end of the second period, the relay 110 is switched to again supply power to the substrate 122. Electroplating of the CMM then continues, preferably with the second set of concentrations, for a third period. By repeating this process more than two distinct CMM layers can be built up. In general plating is performed with a set of concentrations, the relay switches to the dummy electrode 124, the concentrations are changed, and the relay switches back to the substrate electrode 122.

Accordingly, a CMM film with one or more sharp composition transitions is obtained. During the course of the process, the substrate 122 remains submersed in the electrolyte, so that contamination and formation of interfacial native oxides are prevented.

In designing a specific process for depositing a specific CMM film, voltages of the power supplies 106 and 108 and contact areas, for the anodes 116 and 118 are to be determined experimentally. For a given predetermined composition, corresponding to a given depth in a desired CMM film, appropriate concentrations of the first and second dissolved, disassociated compounds are determined experimentally by trial and error using different concentrations, guided by basic electrochemistry knowledge.

A set of voltages for the first and second power supplies are then chosen so that appropriate concentrations will be maintained. The latter can be done by trying different voltages and repeatedly testing concentrations of the first and second dissolved, disassociated compounds to see that they are maintained. The concentrations can for example be tested using an Inductively Coupled Plasma (ICP) spectroscopy instrument.

Rather than optimizing the voltages to maintain the concentrations, rough voltage settings can be preselected, and then a set of areas of contact between the anodes 116, 118, and the electrolyte 126 are optimized by trial and error to determine contact area values which result in the appropriate concentrations being maintained. The process of determining the voltages, or areas is repeated for each of the different compositions in the CMM film.

In the process described above in which the relay 110 is operated to obtain sharp transitions, each composition corresponds to a discrete layer.

In order to minimize the aforementioned second period the volume of the tank 128 should be minimized. An electrolyte agitator (not shown) can also be provided to reduce the second period, and to maintain a homogeneous electrolyte composition, and thus predictable film composition.

A method of forming a CMM electroplated film according to an embodiment of the present invention can comprise the steps of: providing an electrolyte 126, establishing a first predetermined contact area between a first anode 116 and the electrolyte 126, establishing a second predetermined contact area between a second anode 118 and the electrolyte 126, placing an electroplating substrate 122 in contact with the electrolyte 126, placing a dummy electrode 124 in contact with the electrolyte 126, applying a first voltage between the first anode 116 and the electroplating substrate 122 during a first period, applying a second voltage between the second anode 118 and the electroplating substrate 122 during the first period, establishing a third predetermined contact area between a first anode 116 and the dummy electrode 124 during a second period, establishing a fourth predetermined contact area between a second anode 118 and the electrolyte 126 during the second period, applying a third voltage between the first anode 116 and the dummy electrode 124 during the second period, applying a fourth voltage between the second anode 118 and the dummy electrode 124 during the second period, applying a fifth voltage between the first anode 116 and the electroplating substrate 122 during a third period; and applying a sixth voltage between the second anode 118 and the electroplating substrate 122 during the third period. During the third period the third predetermined contact area is preferably maintained between a first anode 116 and the electrolyte, and the fourth predetermined contact area is preferably maintained between the second anode 118 and the electrolyte 126.

The fifth voltage applied during the third period is preferably equal to the third voltage applied during the second period, and the sixth voltage applied during the third period is preferably equal to the fourth voltage applied during the second period. In other words, it is preferable to maintain the voltages used in the second period, in the third period. Alternatively the difference between the voltage used during at least a portion of the second period and the voltage used during the first period, can be greater than the difference between the voltages used during the first and third periods, in order to obtain faster change of concentrations between the concentrations used in the first period and the concentrations used during the third period.

Settings of the first and second power supplies 106, 108 and contact areas set by linear motion transducers 134 and 136 can be controlled in an open loop manner. Alternatively, a set of currents delivered to the anodes 116, 118 can be read using ammeters 112, 114 and used for closed loop control of the power supplies 106, 108 and/or the linear motion servos 134, 136.

In open loop control, the electroplating apparatus 100 is operated based on a first predetermined schedule for the position of at least one of the linear motion transducers 134 and 136 as a function of time, and/or for a voltage settign of at least one of the power supplies 106 and 108 as a function of time. A first computer program is provided that sets up a time function (e.g., using a software construct such as time delay loops or through a system clock), and reads data from the first predetermined schedule, and adjusts at least one voltage applied to the power supplies 106, 108 through the digital-to-analog converter according to the first predetermined schedule, and/or adjust the position of at least on of the linear motion servos 134 and 136 through the servo control 138 according to the first predetermined schedule.

In closed loop control, the electroplating apparatus 100 is operated based on a second predetermined schedule for a current supplied to one of the anodes 116 and 118, or currents supplied to both anodes 116 and 118. A second computer program is provided which reads the second predetermined schedule, reads one or both of the ammeters 112, 114 through the analog-to-digital converter 118, and adjusts at least one voltage applied to power supplies 106, 108 through the digital-to-analog converter 104, and/or at least one contact area between an anode 116 and/or 118 and the electrolyte solution 126, in order to make the current supplied to one or both of the anodes nominally equal to a current specified in the second predetermined schedule for a particular instant of time. In one specific embodiment the second computer program can implement a proportional integral differential (PID) feedback control algorithm to control the power supplies 106 and/or 108. A PID algorithm may result in there being a residual difference between a target current specified in the second predetermined schedule and an actual current obtained. For that reason, the term 'nominally equal' is used.

In the case of contact area control, the second computer program operates the control computer 102, servo controller 138, and analog-to-digital controller 118 to function as a feedback control system. In the case of voltage control, the second computer program operates the control computer 102, digital-to-analog converter 104, and analog-to-digital converter 118 to function as a feedback control system. Current passing through an anode 116 or 118 increases as the contact area between the anode 116 or 118 and the electrolyte increases, and increases as the voltage of the power supply 106, 108 coupled to the anode 116 or 118 increases.

In order to obtain a specific CMM film the predetermine schedules are designed to vary at least one contact area and/or at least one voltage setting, so that different compositions are obtained at different depths in the deposited film. According to some embodiments, voltage and current can be controlled independently with the help of potentiostats.

Further, in order to obtain CMM films with abrupt composition transitions, the state of the relay 110 is changed to switch between supplying power to the substrate 122, and the dummy electrode 124.

The aforementioned first computer program, second computer program, first predetermined schedule, and second predetermined schedule can be stored on computer readable medium 142.

Figure 2:
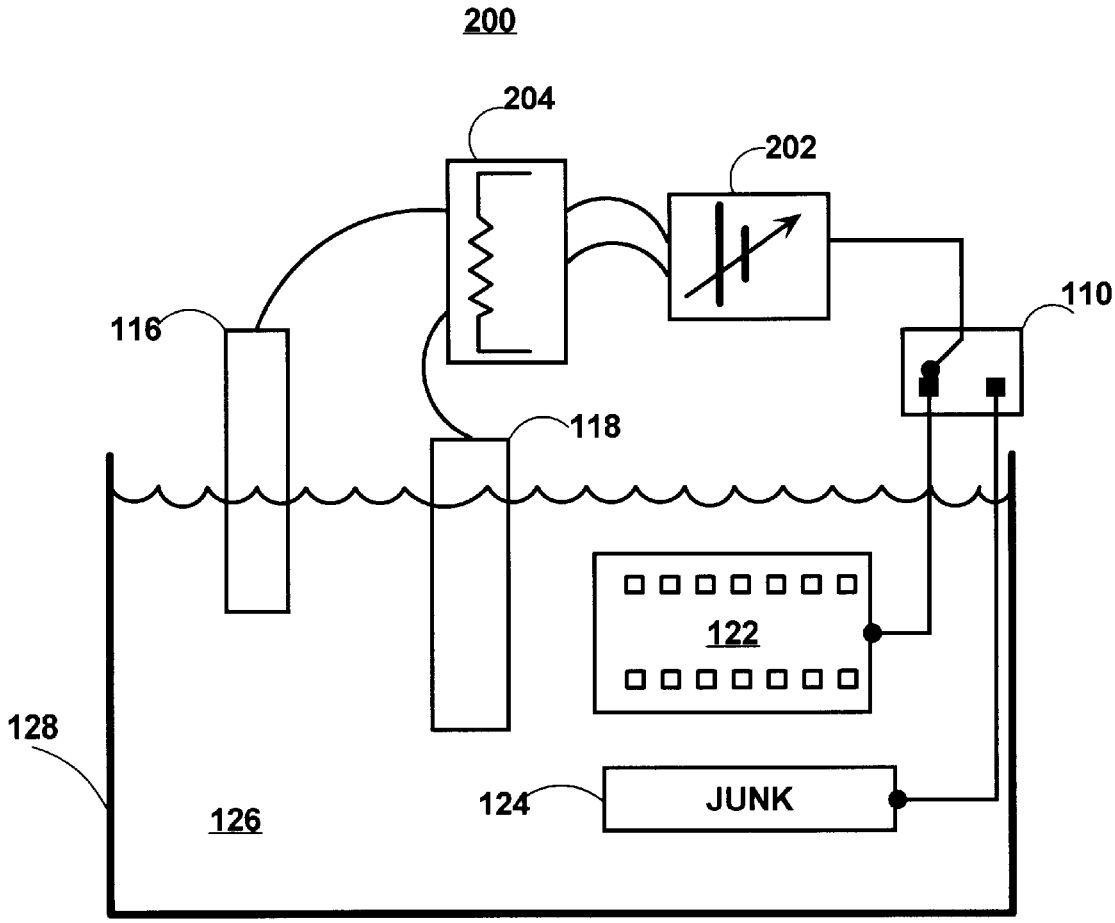
FIG. 2 is a partial schematic of an electroplating apparatus having a different power supply arrangement in accordance with a second embodiment of the invention.

FIG. 2 is a partial schematic diagram of an electroplating apparatus having a different power supply arrangement according to a second embodiment of the invention.

In FIGS. 1 and 2 like elements are denoted by the same reference numerals. These elements are described above in connection with FIG. 1, and some are not described again below.

Referring to FIG. 2, a single power supply 202 is connected to the two anodes 116, 118 through an impedance network 204. The impedance network 204 divides a current supplied by the power supply 202 between the two anodes 116, 118. The impedance network can be fixed or can include variable impedance elements, (e.g., rheostat or resistors). The combination of a power supply 202, and a variable impedance element is one example of a variable power supply.

Figure 3:
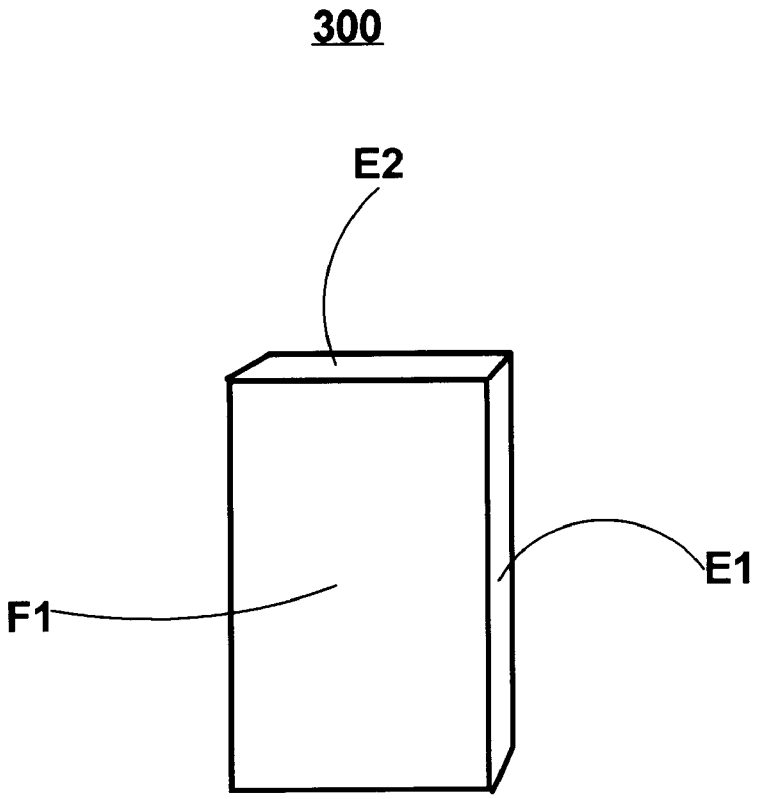
FIG. 3 depicts an electroplating anode geometry according to one preferred embodiment of the present invention.

FIG. 3 shows an electroplating anode geometry according to a preferred embodiment of the invention.

The anode 300 comprises an upper edge E2, a lower edge opposite to the upper edge E2, a right side edge E1, and left side edge opposite to the right edge E1, a front face F1, and a back face opposite to the front face F1. The sum of the surface area of the front face F1 and the back face is preferably approximately equal to a total surface area of all the faces and edges of the anode 300. In such a case, the surface area is relatively stable as the mass of the anode is reduced in the course of electroplating. This is especially preferable in the case of open loop control of the electroplating apparatus.

Figure 4:
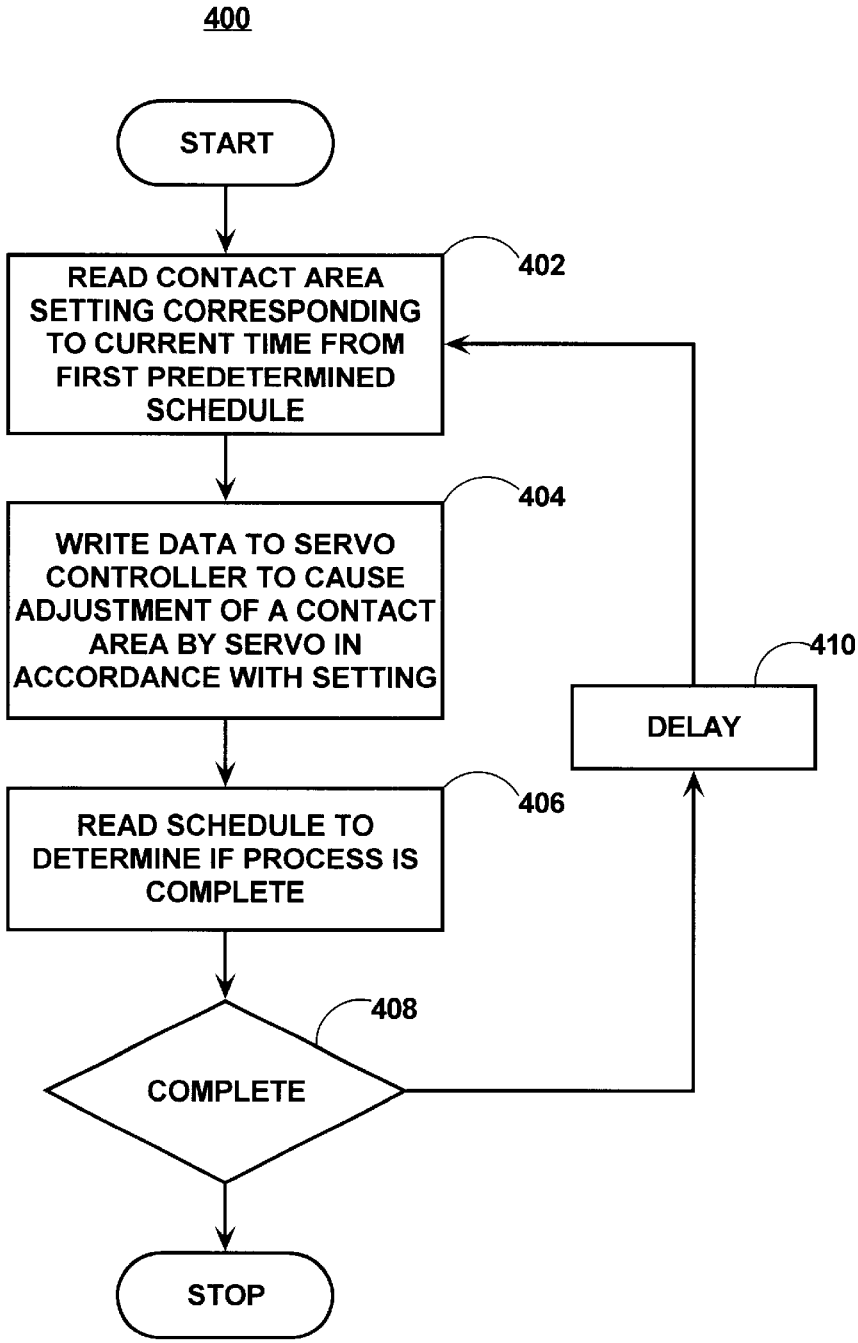
FIG. 4 is a flow diagram of an open loop control process performed by a control computer for controlling an anode contact area in an electroplating apparatus according to another preferred embodiment of the present invention.

FIG. 4 is a flow diagram of an open loop control process 400 performed by a control computer for controlling an anode contact area in an electroplating apparatus according to a preferred embodiment of the present invention. In process block 402, a contact area setting corresponding to the current time is read from a first predetermined schedule. In process block 404, data is written to the servo controller 138 to cause adjustment of a contact area between an anode 116, 118 and the electrolyte 126, by a servo 134, 136 in accordance with the setting read in process block 402. In process block 406, the schedule is read to determine if the process is complete. Process block 408 is a decision block the outcome of which depends on whether the first predetermined schedule, and the process 400 for CMM film plating is complete. If not complete, then the process 400 loops back to process block 402 after a delay 410, to process block 402. If complete then the process terminates. Other control functions can be added to those shown in FIG. 4 including but not limited to altering power supply 106, 108 settings at different points in the process, and controlling the state of relay 110.

Figure 5:
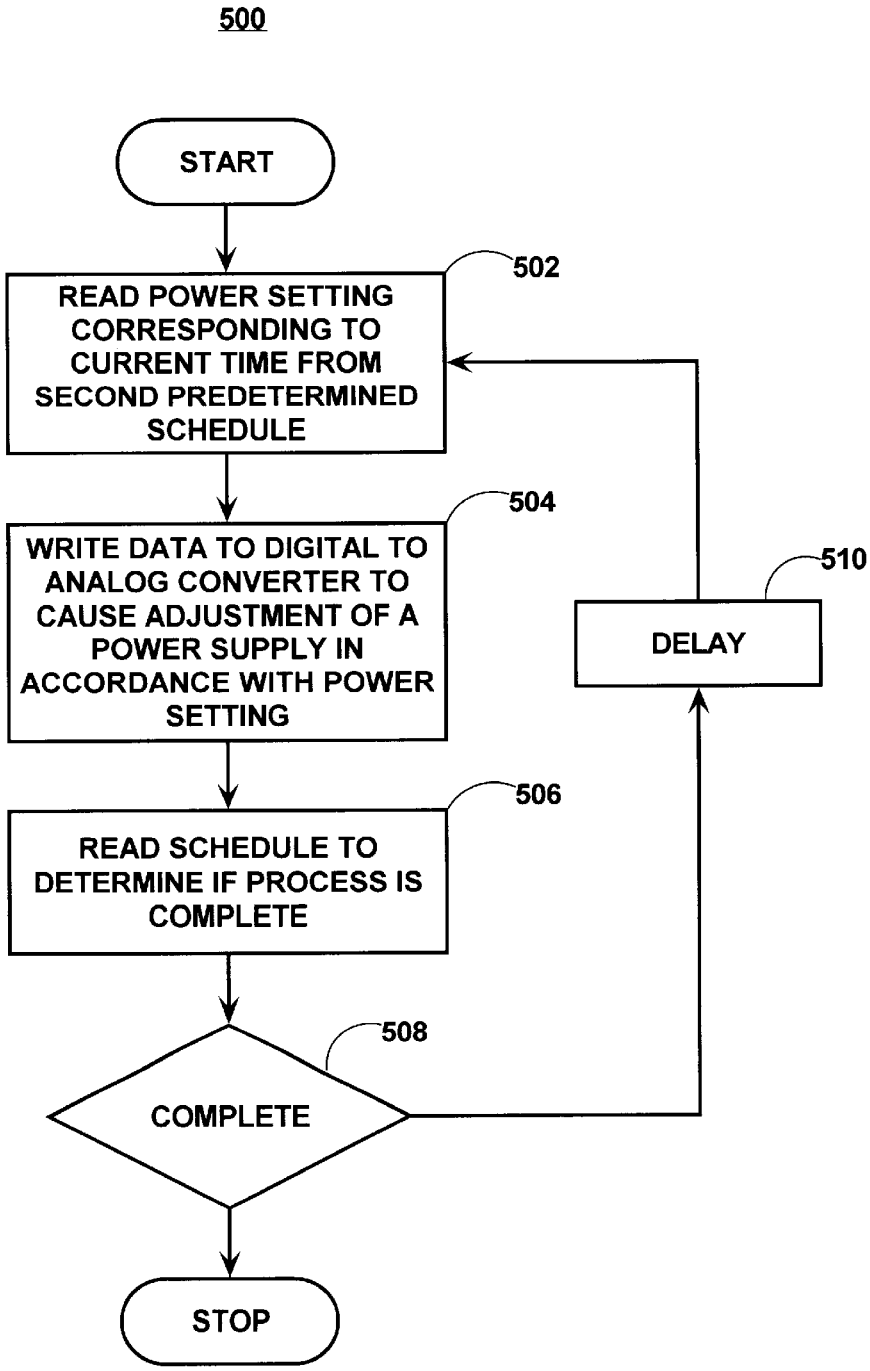
FIG. 5 is a flow diagram of an open loop control process performed by a control computer for controlling the power supply setting in an electroplating apparatus according to yet another preferred embodiment of the present invention.

FIG. 5 is a flow diagram of an open loop control process 500 performed by control computer for controlling power supply setting in an electroplating apparatus according to another preferred embodiment of the present invention.

In process block 502 a power setting corresponding to the current time is read from a second predetermined schedule.

In process block 504 data is written to the digital-to-analog converter 104 to cause adjustment of at least one of the power supplies 106 and 108 in accordance with the power setting read in process block 502.

In process block 506, the second predetermined schedule is read to determine is the process is complete. Process block 508 is a decision block, the outcome of which depends on whether the second predetermined schedule and the CMM plating process is complete. If not then the process 500 loops back through a delay to process block 502. If complete then the process 500 terminates.

Figure 6:
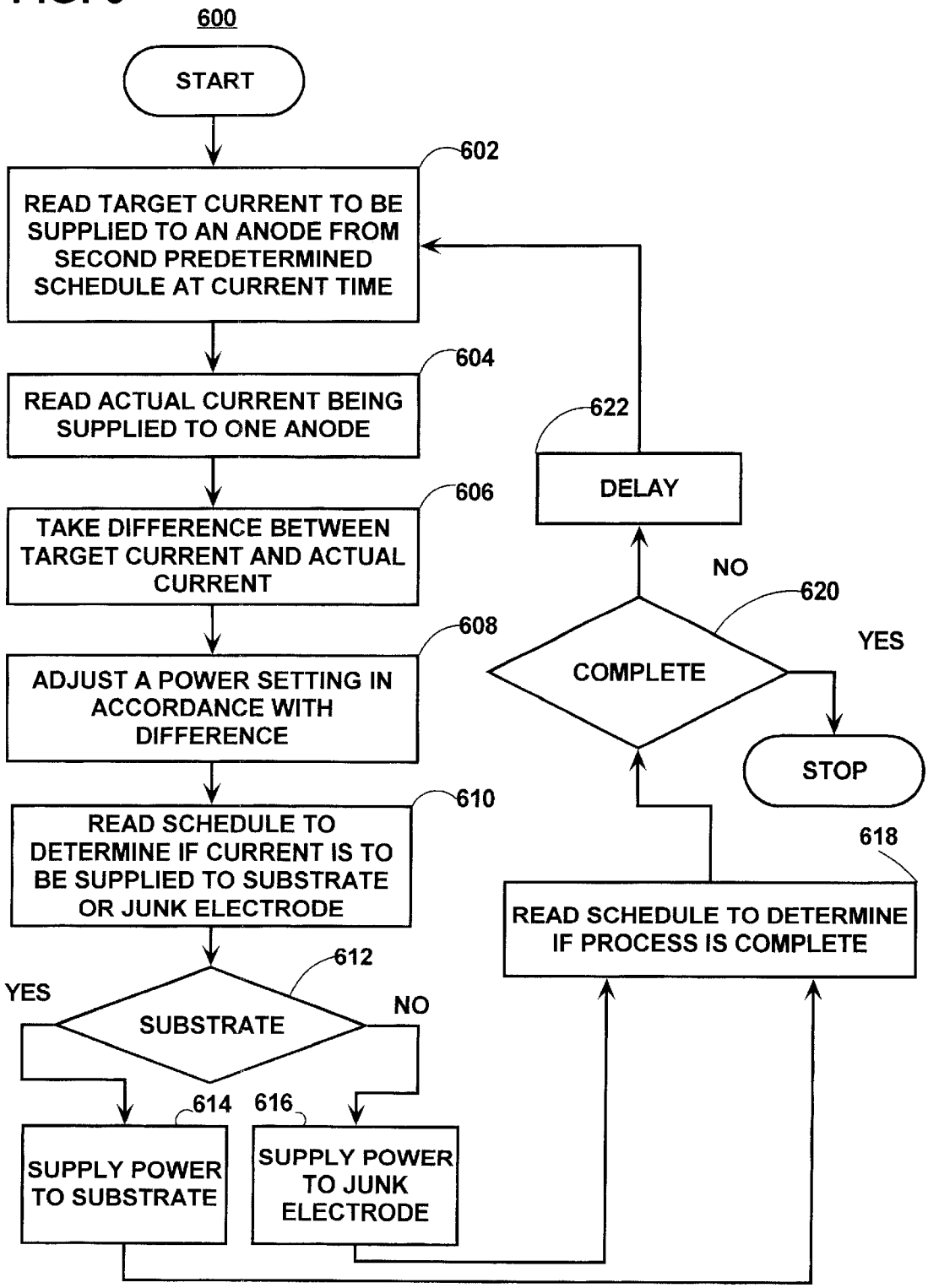
FIG. 6 is a flow diagram of a closed loop control process performed by a control computer for controlling a power supply setting in an electroplating apparatus according to another embodiment of the present invention.

FIG. 6 is a flow diagram of a closed loop control process 600 performed by control computer 102 for controlling power supply setting in an electroplating apparatus 100 according to a yet another embodiment of the invention.

In process block 602, a target current to be supplied to at least one of the anodes at the current time is read from the second predetermined schedule. Preferably, the second predetermined schedule is read from computer readable medium 142. The second predetermined schedule includes a sequence of entries, each of which specifies a beginning time, an ending time, an anode current value for each of the anodes, 116, 118, and a field which specifies whether current is to be supplied to the electroplating substrate 122, or the dummy electrode 124. The current time is a relative time measured from a start of the process 600. In carrying out process block 602, the current time will be checked against the beginning times and ending times of the sequence of entries to determine which entry applies to the current time. In process block 604, an actual current being supplied to the anode is read by the control computer 102, through the analog-to-digital converter 120, from an ammeter 112 or 114. In process block 606, a difference between the target current and the actual current is computed. In process block 608, a power setting (e.g. voltage) of a power supply 106 or 108 is adjusted in accordance with the difference. In electroplating, anode current increases with increasing voltage. The dependence is approximately but not exactly exponential. The exact functional relationship between anode current and anode voltage is may vary in different implementations of the invention, and is not critical to the invention. A PID feedback control algorithm is preferably used in determining an adjustment to be made to the power setting based on the difference computed in process block 606 in order to bring the actual current closer to the target current. A detailed description of PID control algorithms can be found in *Basic Feedback Control Systems,* Alternate $2^{nd}$ Ed, New Jersey, Prentice Hall 1991, which is incorporated herein by reference. PID control algorithms are available as a software library from National Instruments of Austin, Tex. under the trade name of The Componentworks PID Toolkit.

In process block 610, the second predetermined schedule is read to determine if current is to be supplied to the substrate 122 or the dummy electrode 124 at the current time. Process block 612 is a decision block, the outcome of which depends on whether current is to be supplied to the substrate 122. If, according to the second predetermined schedule, current is to be supplied to the substrate 122, then in process block 614 current is supplied to the substrate. If current is to be supplied to the dummy electrode 124, then in process block 616 current is supplied to the dummy electrode 124. Selection of either the substrate 122 or the dummy electrode 124 is carried out by control computer by operating the relay 110 through the digital-to-analog converter 104.

From process blocks 614 or 616 the process 600 continues with process block 618, in which it is determined, based on the second predetermined schedule if the electroplating process is complete. In carrying out process block 618 a current time can be checked against an ending time in a last entry in the sequence of entries of the second predetermined schedule. Process block 620 is a decision block, the outcome of which depends on whether, as determined in process block 618, the process 600 is complete. If complete, then the process terminates. If not complete, then the process 600 loops back through a delay 622 to process block 602.

In this process the power settings of both of the power supplies 106, 108 are preferably adjusted in order to maintain each anode current in conformance with the second predetermined schedule.

Figure 7:
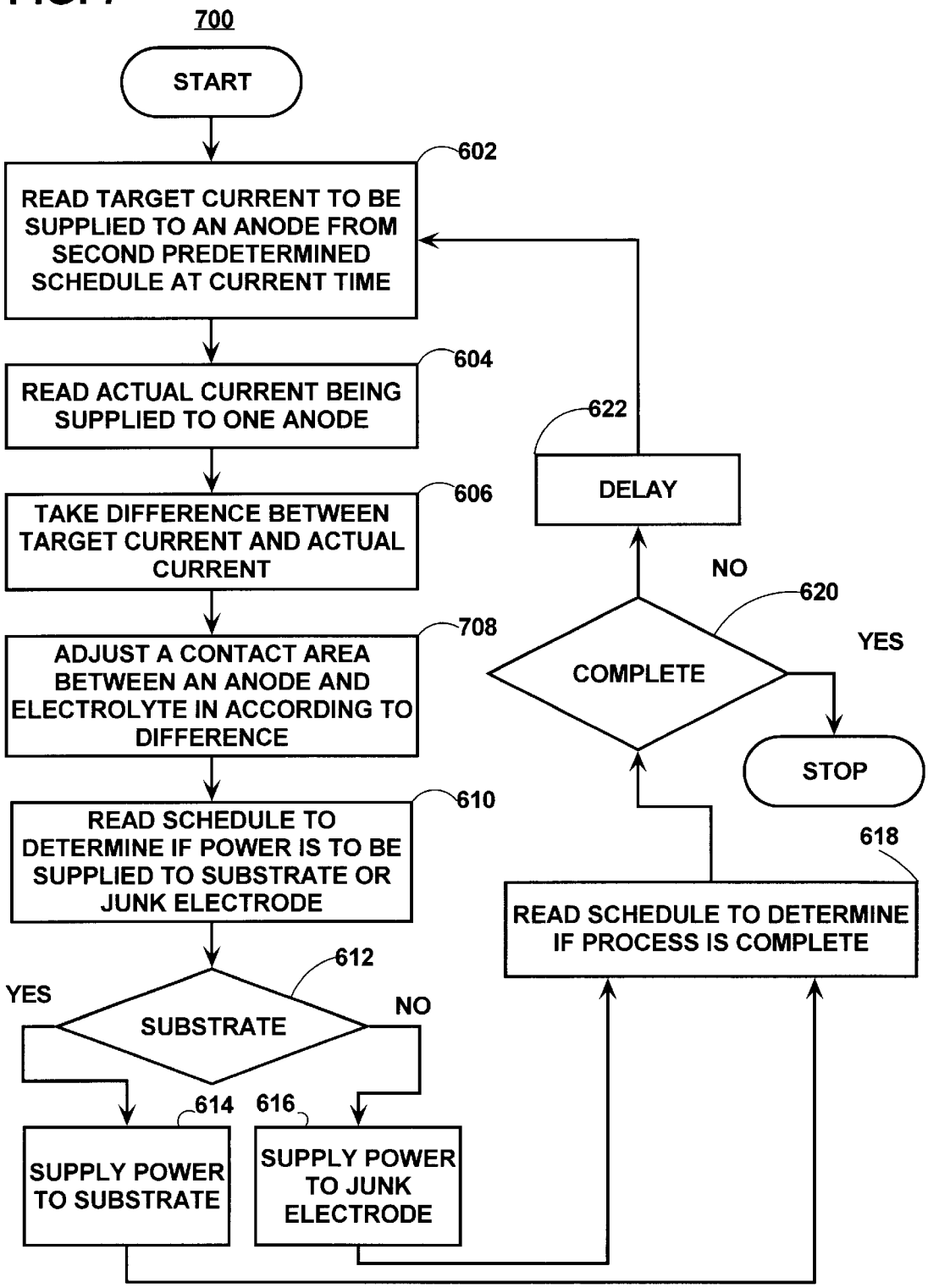
FIG. 7 is a flow diagram of a closed loop control process performed by control computer for controlling an anode to electrolyte contact area in an electroplating apparatus according to still another embodiment of the invention.

FIG. 7 is a flow diagram of a closed loop control process 700 performed by a control computer 102 for controlling a contact area between an anode 116, 118 and the electrolyte 126 in the electroplating apparatus 100 according to yet another embodiment of the present invention.

As indicated by the commonality of reference numerals, process 700 inherits from process 600 all process blocks except for process block 708. In process block 708 a contact area between an anode 116, 118 is adjusted in accordance with the difference obtained in process block 608, in order to bring the actual current measured in process block 604 closer to the target current measured in process block 606. A PID feedback control algorithm can be used in determining an adjustment made in process block 708.

In this process contact areas between the electrolyte 126, and both of the anodes 116 and 118 are preferably adjusted in order to maintain the current of each in conformance with the second predetermined schedule. It is also possible to use a process in which both power supply settings, and contact areas are adjusted in order to maintain anode currents in conformance with the second predetermined schedule. Current is expected to have a nearly linear (in fact, nearly proportional) dependence on contact area for a fixed anode voltage. In a practical system some nonlinearities can be expected to occur. Small nonlinearities do not defeat the feedback control algorithm.

The following is an exemplary format for the predetermined schedule for obtaining a two layer CMM with a sharp interface between two successive film layers.

| BEGIN TIME | END TIME | ANODE 116 CURRENT | ANODE 118 CURRENT | CATHODE SELECTION |
|---|---|---|---|---|
| T1 | T2 | Ia | Ib | SUBSTRATE |
| T2 | T3 | Ic | Id | DUMMY |
| T3 | T4 | Ic | Id | SUBSTRATE |

In this exemplary process, a first film layer is deposited on the substrate 122 during a first period between T1 and T2. The first film layer is a first alloy of two metals of the two anodes 114, 116 in relative percentages that depend on currents Ia and Ib. The values of Ia and Ib are experimentally determined to obtain the first alloy. During the first period there is a first set of concentrations of the two dissolved disassociated compounds including metals from the two anodes 116, 118.

A second film layer is deposited on the substrate 122 during a third period between T3 and T4. The second film layer is a second alloy of two metals corresponding to the two anodes 114, 116 in relative percentages that depend on currents Ic and Id. The values of Ic and Id are experimentally determined to obtain the second alloy. During the third period there is a second set of concentrations of two dissolved disassociated compounds including respectively elements from the two anodes 116, 118. The second set of concentrations corresponds to the currents Ic and Id. In other words with currents maintained at Ic, Id the second set of concentrations will be maintained.

During a second period between T2 and T3 concentrations of the two dissolved disassociated compounds gradually changes from the first set of concentrations to the second set of concentrations. During the second, period the relay 110 is switched to supply current to the dummy electrode in lieu of the substrate. During the second period, a film with a smoothly varying composition is deposited onto the dummy electrode 124, but not onto the substrate.

The transition in between the second alloy and the first alloy in the film deposited onto the substrate 122 will be abrupt.

The arrangement of the algorithms discussed in connection with FIGS. 6 and 7 should be taken as exemplary, not limiting.

Software for carrying out the processes depicted in FIGS. 4–7 may be loaded onto the control computer 102 from the computer readable medium 142. The predetermined schedules read in the process shown in FIGS. 4–7 can be loaded onto the control computer 102 from the computer readable medium.

Power supplies 106, 108 can be self regulating such that they have internal feedback and control circuits for maintaining current or voltage at a predetermined setting. A voltage regulating power supply would be particularly useful in a process in which the contact area between the electrolyte 126 and anodes 116, 118 is controlled in order to control the composition of a deposited film. A current regulating power supply is particularly useful in a process in which a power supply setting (current in this case) is controlled to control the composition of a deposited film. If a power supply with an external control input, an internal current regulating circuitry is used, it is possible to dispense with ammeters 112, 114 an analog-to-digital converter 120.

Future developments in computational electrochemistry may reduce or eliminate the need for experimentation in determining voltages and contact areas. It may be possible to determine correct power and contact area settings based on a mathematical model.

While there has been illustrated and described what are presently considered to be the preferred embodiments of the present invention, it will be understood by those skilled in the art that various other modifications may be made, and equivalents may be substituted, without departing from the true scope of the present invention. Additionally, many modifications may be made to adapt a particular situation to the teachings of the present invention without departing from the central inventive concept described herein. Furthermore, an embodiment of the present invention may not include all of the features described above. Therefore, it is intended that the present invention not be limited to the particular embodiments disclosed, but that the invention include all embodiments falling within the scope of the appended claims.

What is claimed is:

1. An apparatus for depositing a composition film comprising a first metal and a second metal on a substrate, the apparatus comprising:

a container for containing an electrolyte solution;

a support for a first anode comprising the first metal;

a support for a second anode comprising the second metal; and a first servo for changing a first contact area between the first anode and the electrolyte.

2. The apparatus according to claim 1, wherein the first servo is a linear motion servo.

3. The apparatus according to claim 1, further comprising;

a servo controller electrically coupled to the first servo; and a computer electrically coupled to the servo controller, the computer controlling the first servo through the servo controller.

4. The apparatus according to claim 1, further comprising:

a servo for changing a second contact area between the second anode and the electrolyte.

5. The apparatus according to claim 1, further comprising a first power supply including:

a first anode terminal electrically coupled through a first ammeter to the first anode; and an electrical device selectively coupling to either an electroplating substrate or a dummy electrode.

6. The apparatus according to claim 5, further comprising:

an electrical device for selectively coupling the first negative terminal to a either an electroplating substrate or a dummy electrode.

7. The apparatus of claim 5, further comprising:

an electrical device for selectively coupling the first negative terminal and the second negative terminal to a either an electroplating substrate or a dummy electrode.

8. The apparatus according to claim 1, further comprising:

a first power supply including:

a first anode terminal electrically coupled through a first ammeter to the first anode; and a first negative terminal; and a second power supply including:

a second anode terminal electrically coupled through a second ammeter to the second anode; and a second negative terminal.

9. An apparatus for depositing a composition film comprising a first metal and a second metal on a substrate, the apparatus comprising:

a container;

an electrolyte contained in the container, the electrolyte including:

a first dissolved disassociated compound including the first metal; and a second dissolved disassociated compound including the second metal;

a first anode comprising the first metal;

a second anode comprising the second metal; and a first mechanism for changing a first contact area between the first anode and the electrolyte.

10. The apparatus of claim 9 wherein:

the first anode is flat, and the second anode is flat.

11. The apparatus according to claim 9, wherein the first mechanism is a linear motion servo.

12. The apparatus according to claim 11, further comprising:

means for changing a second contact area between the second anode and the electrolyte.

13. A method of electroplating comprising the step of:

providing an electrolyte;

providing a first anode; and selectively changing a first contact area between the electrolyte and the first anode.

14. The method of electroplating according to claim 13 further comprising the steps of:

providing a second anode; and selectively changing a second contact area between the electrolyte and a second anode.

15. The method according to claim 14, further comprising the steps of:

establishing the third predetermined contact area between the first anode and the electrolyte during the third period; and establishing the fourth predetermined contact area between the second anode and the electrolyte during the third period.

16. The method according to claim 15, wherein;

the fifth voltage is equal to the third voltage, and the sixth voltage is equal to the fourth voltage.

17. The method of electroplating according to claim 13 wherein the first contact area is selectively changed in order to deposit a multilayer film.

18. The method of claim 15 wherein the multilayer film is a CMM film having a sharp transition between at least two layers.

19. A method of electroplating comprising the steps of:

providing an electrolyte;

placing an electroplating substrate in contact with the electrolyte;

establishing a first predetermined contact area between a first anode and the electrolyte;

establishing a second predetermined contact area between a second anode and the electrolyte;

establishing a third predetermined contact area between the first anode and the dummy electrode during a second period; and establishing a fourth predetermined contact area between the second anode and the electrolyte during the second period.

20. The method of claim 19, further comprising the steps of:

placing a dummy electrode in contact with the electrolyte;

applying a first voltage between the first anode and the electroplating substrate during a first period; and applying a second voltage between the second anode and the electroplating substrate during the first period.

21. The method according to claim 20, further comprising the steps of:

applying a third voltage between the first anode and the dummy electrode during the second period;

applying a fourth voltage between the second anode and the dummy electrode during the second period;

applying a fifth voltage between the first anode and the electroplating substrate during a third period; and applying a sixth voltage between the second anode and the electroplating substrate during the third period.

22. A method of electroplating comprising the steps of:

providing an electrolyte comprising a first dissolved disassociated compound including a first metal at a first predetermined concentration and a second dissolved disassociated compound including a second metal at a second predetermined concentration;

placing a substrate in contact with the electrolyte;

placing a first anode, including the first metal in contact with the electrolyte;

placing a second anode, including the second metal, in contact with the electrolyte;

applying a first voltage signal between the substrate and the first anode;

applying a second voltage signal between the substrate and the second anode; and varying a first area of the first anode in contact with the electrolyte.

23. The method of claim 22, further comprising the step of:

varying a second area of the second anode in contact with the electrolyte.

24. The method of claim 22, wherein the step of applying a second voltage comprises the step of:

applying a second voltage signal equal to the first voltage signal between the substrate and the second anode.

* * * * *